US006292112B1

(12) United States Patent
Bader et al.

(10) Patent No.: US 6,292,112 B1
(45) **Date of Patent: *Sep. 18, 2001**

(54) VEHICLE PRESENCE DETECTION SYSTEM

(75) Inventors: Clifford Bader, West Chester; Charles De Renzi, Exton, both of PA (US)

(73) Assignee: 3461513 Canada Inc., Kirkland (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/460,793

(22) Filed: Dec. 14, 1999

Related U.S. Application Data

(63) Continuation of application No. PCT/IB98/00978, filed on Jun. 24, 1998, which is a continuation of application No. 08/882,263, filed on Jun. 25, 1992, now Pat. No. 5,868,360.

(51) Int. Cl.[7] ..... G08G 1/01

(52) U.S. Cl. ..... 340/941; 340/901; 340/933; 340/341; 246/202; 246/249; 246/247; 324/178; 324/179

(58) Field of Search ..... 340/941, 341, 340/901, 933; 246/202, 249, 247; 324/178, 179

(56) References Cited

U.S. PATENT DOCUMENTS

| | | | |
|---|---|---|---|
| 1,797,302 | 3/1931 | Vantassel . | |
| 2,224,395 | 12/1940 | Kemmerer . | |
| 3,210,539 | 10/1965 | Malaquin . | |
| 3,271,821 | 9/1966 | Street . | |
| 3,359,417 | 12/1967 | Gallagher . | |
| 3,395,341 | 7/1968 | Malaquin . | |
| 3,573,441 | 4/1971 | Glazer . | |
| 4,179,744 | 12/1979 | Lowe . | |
| 4,283,031 | 8/1981 | Finch . | |
| 4,361,202 | 11/1982 | Minovitch . | |
| 4,379,330 | 4/1983 | Sanville . | |
| 4,727,372 | 2/1988 | Buttemer . | |
| 4,787,581 * | 11/1988 | Dobler et al. | 246/247 |
| 4,968,979 | 11/1990 | Mizuno et al. . | |
| 5,025,218 | 6/1991 | Ramstedt . | |
| 5,333,820 * | 8/1994 | Gilcher | 246/249 |
| 5,471,139 | 11/1995 | Zadoff . | |
| 5,757,178 * | 5/1998 | Luehrs et al. | 324/178 |
| 5,825,177 * | 10/1998 | Finnestad et al. | 324/179 |

* cited by examiner

*Primary Examiner*—Daniel J. Wu
*Assistant Examiner*—Tai T. Nguyen
(74) *Attorney, Agent, or Firm*—James Anglehart; Swabey Ogilvy Renault

(57) ABSTRACT

A passive magnetic detector is provided at ground level or buried below ground level in between rails of a railroad track at a distance from the level crossing for detecting magnetic field disturbances caused by ferromagnetic objects passing overhead on the track. Magnetic field reversals are detected in the passive detector signal. The reversal signal is analyzed and a train presence output signal is generated for controlling a level crossing gate system or other such crossing warning system. For parallel tracks, pairs of passive magnetic field detectors detect objects over each track and the reversals are analyzed to check that an inbound train does not sneak by undetected as an outbound train is leaving and passing over the same detector pair. At the level crossing, static magnetic field detectors are used to ensure that no equipment remains on the island after detecting that the moving train has left the crossing, so that the crossing gates can be safely lifted as soon as possible.

34 Claims, 10 Drawing Sheets

TWO TRACK, SINGLE CROSSING ARRAY

FIG. 2 TWO TRACK, SINGLE CROSSING ARRAY

TEST TRACK LAYOUT

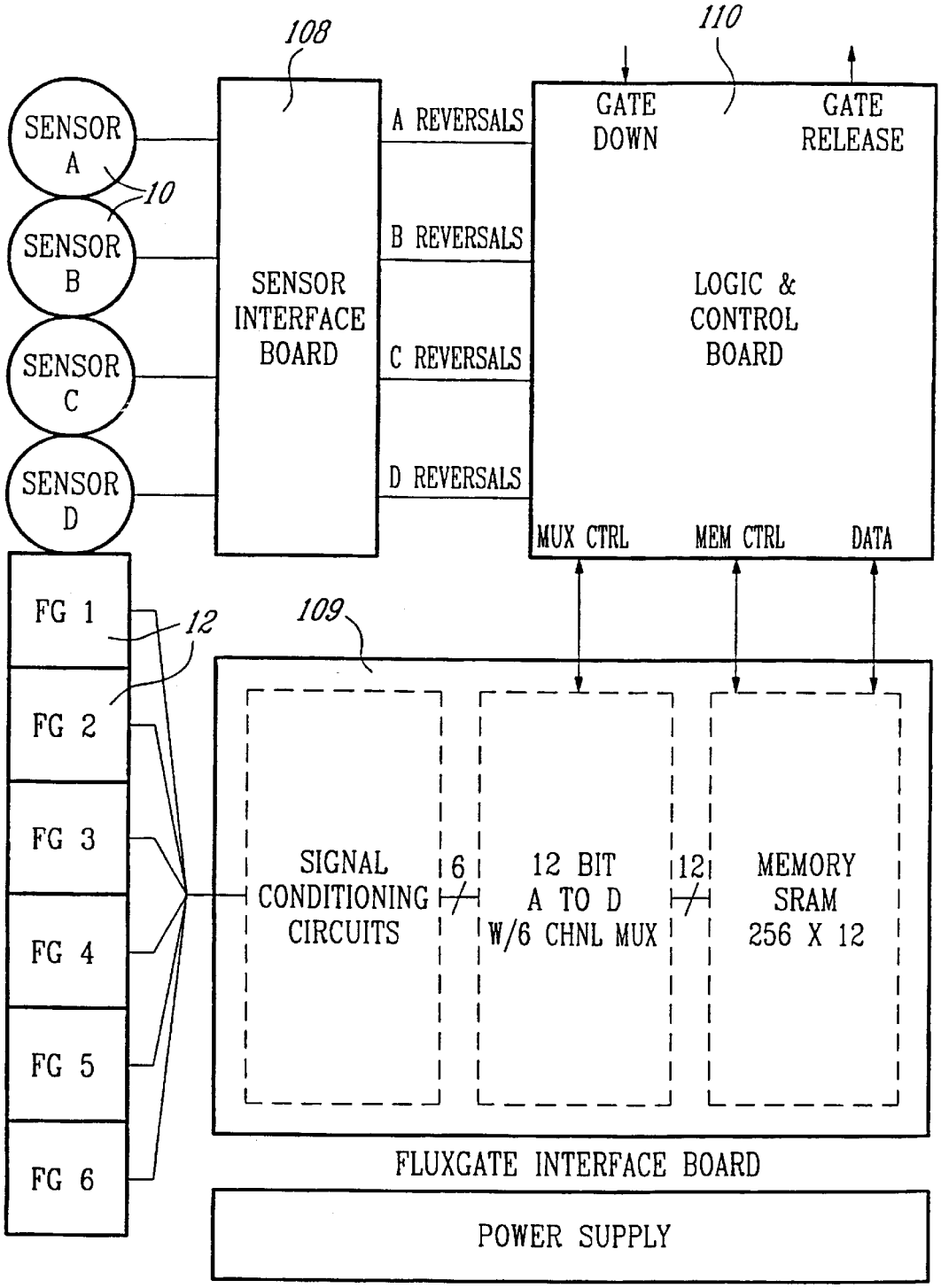
FIG. 5 ADJUNCT SYSTEM BLOCK DIAGRAM

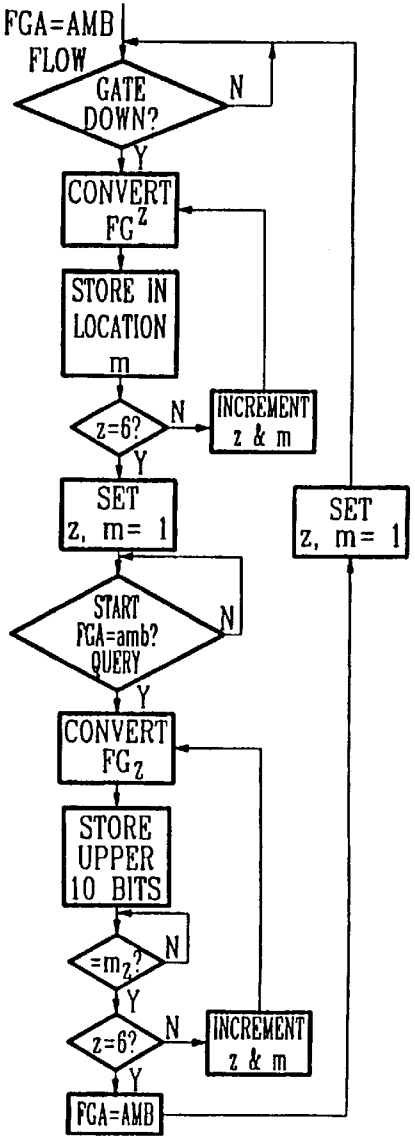
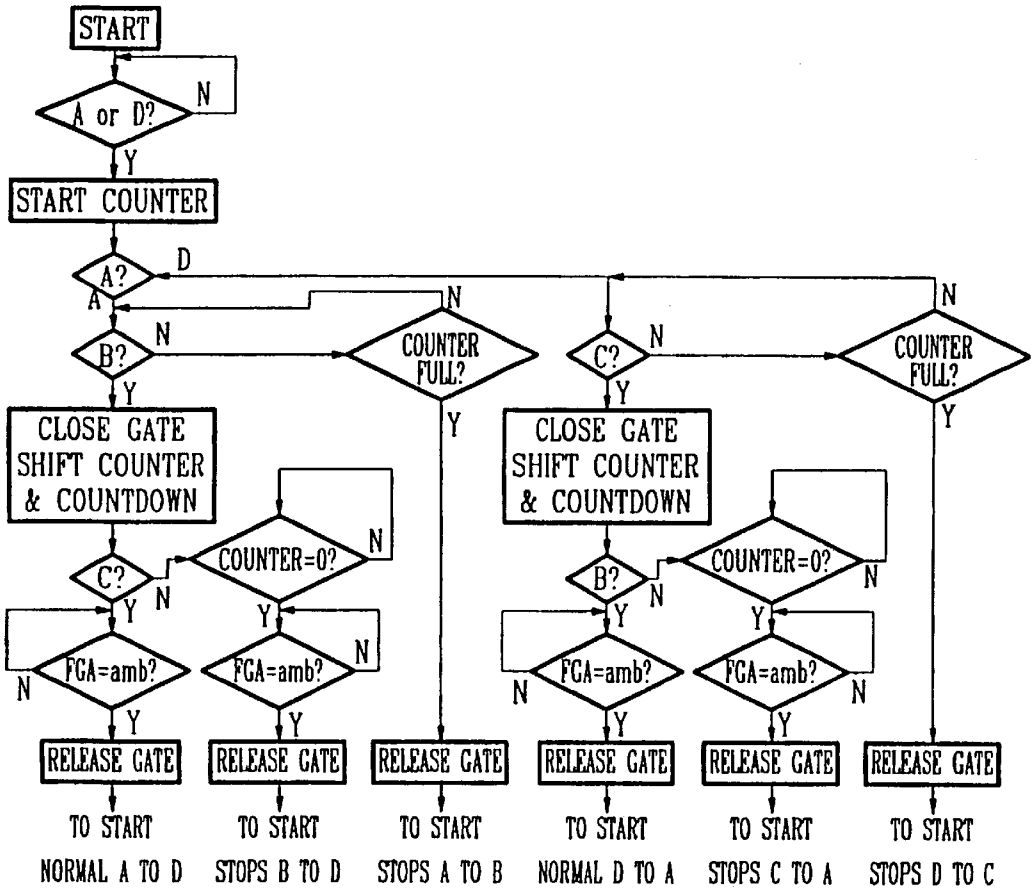
FIG. 6 ADJUNCT SYSTEM FLOWCHART 4/18/97

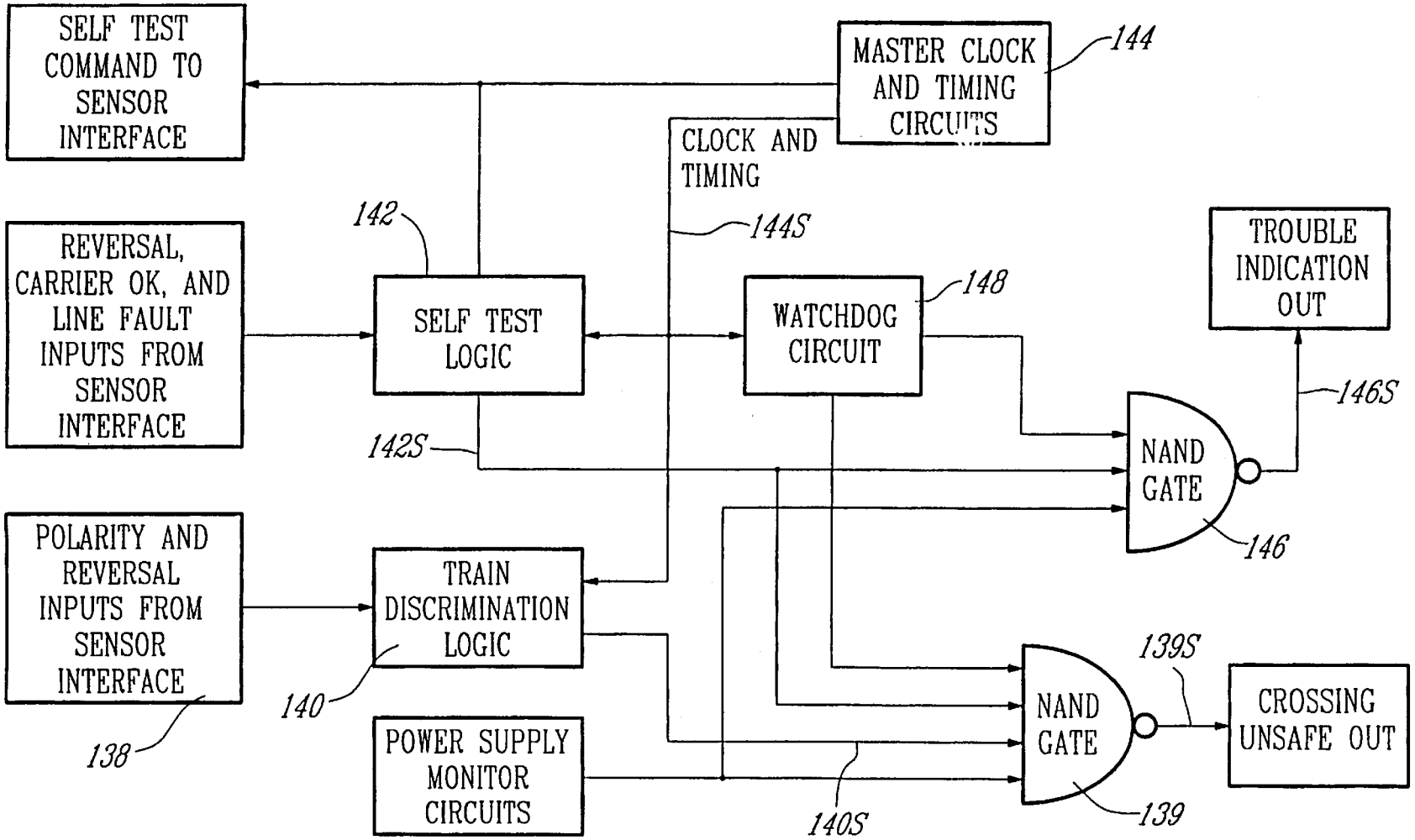
FIG. 7 CROSSING PROTECTION SYSTEM CONTROL BLOCK DIAGRAM

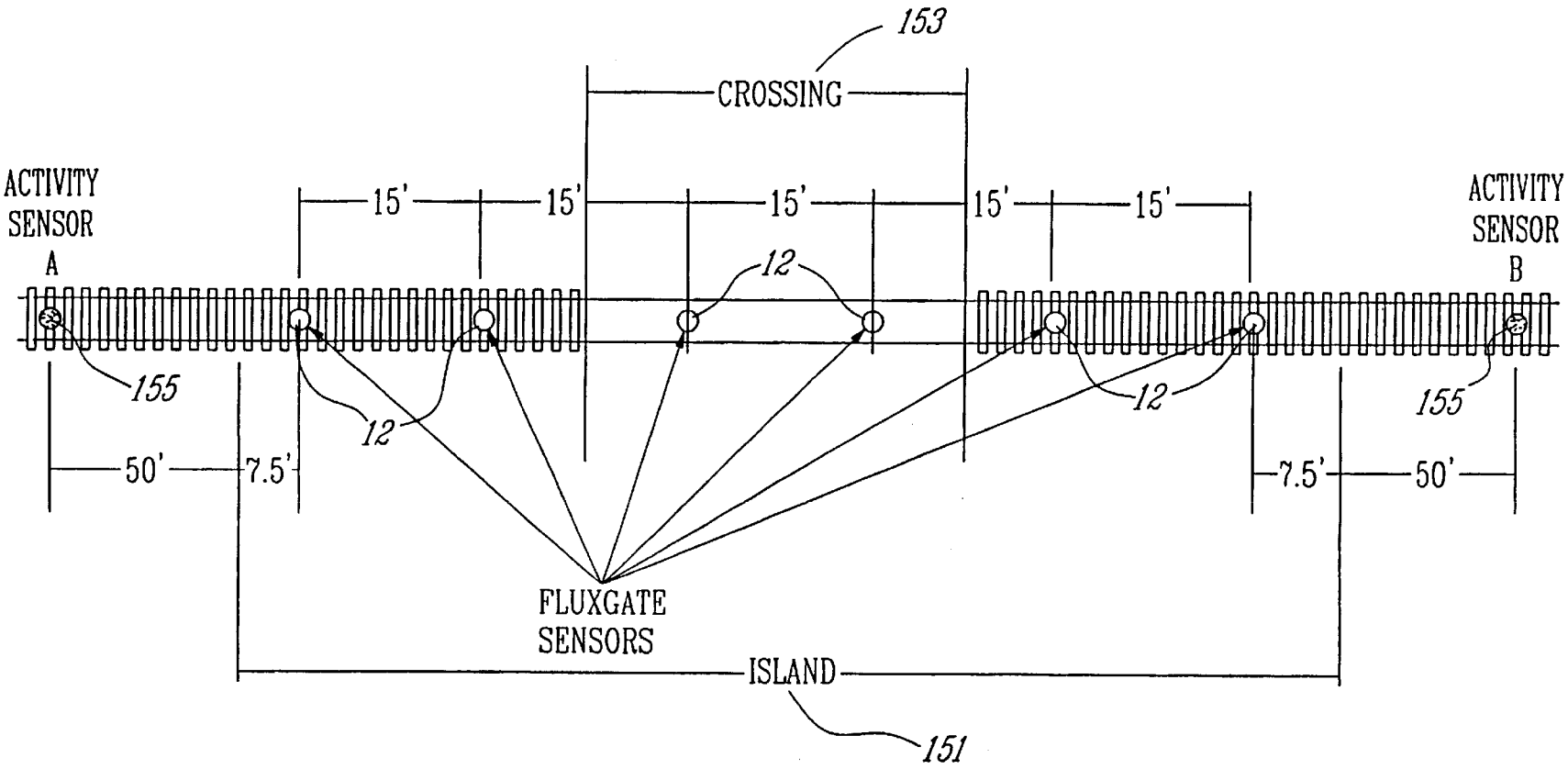
FIG. 8 ISLAND PROTECTION SYSTEM LAYOUT

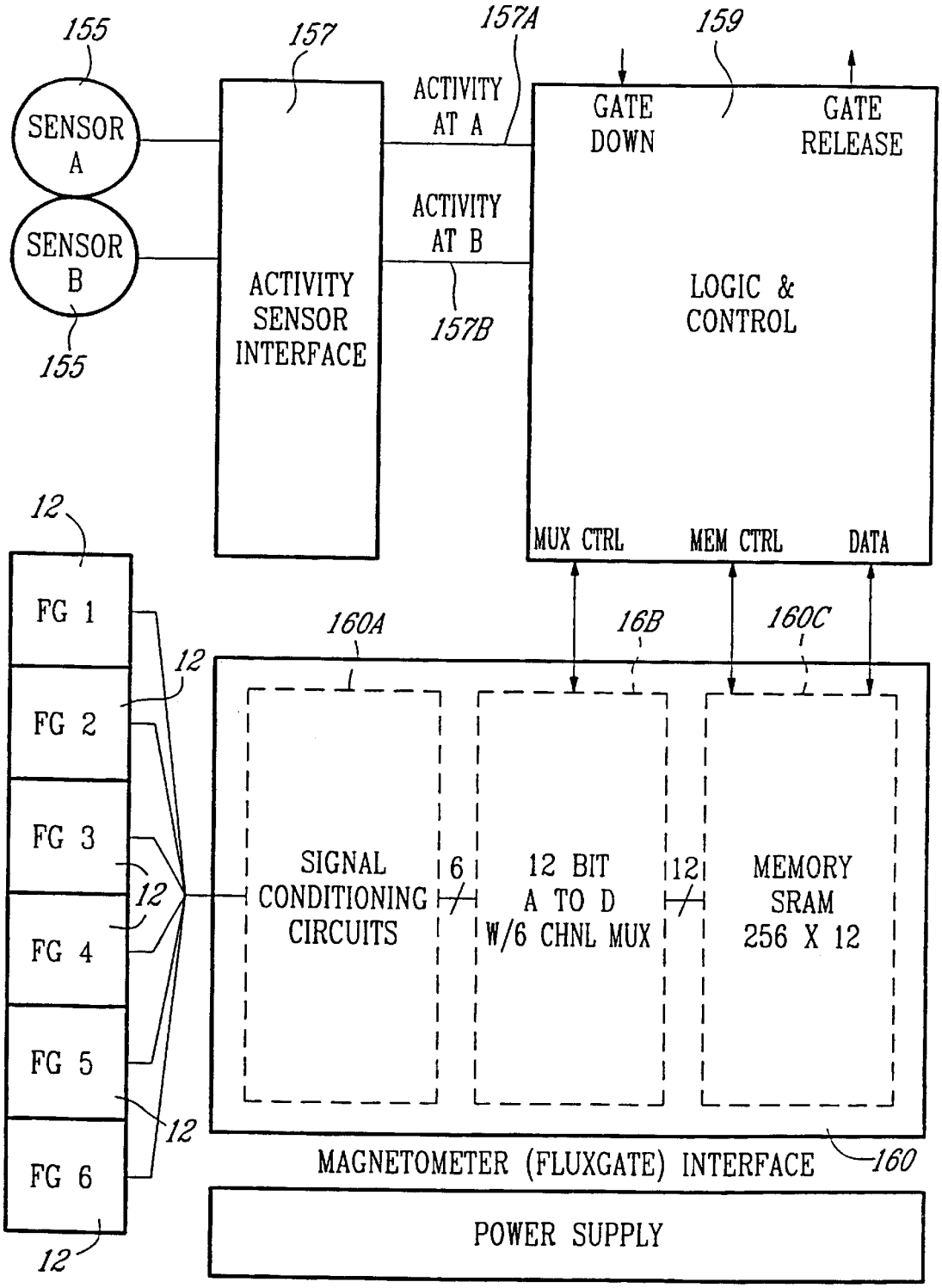
FIG. 9 ISLAND PROTECTION SYSTEM BLOCK DIAGRAM

VEHICLE PRESENCE DETECTION SYSTEM

This application is a continuation of PCT patent application PCT/IB98/00978 filed on Jun. 24, 1998 and now pending in the International Phase with a designation and election of the United States, which is a continuation of U.S. patent application Ser. No. 08/882,263 filed Jun. 25, 1997, now U.S. Pat. No. 5,868,360.

FIELD OF THE INVENTION

The present invention relates to a vehicle presence detection system for detecting the presence of trains or the like. In particular, the invention relates to a train presence detection apparatus for use with a level crossing gate system or other such warning system equipment, a vehicle motion detector circuit for analyzing a passive magnetic field detector output signal to generate a lane or track indicating signal, and a stationary or slow moving train presence detection apparatus for detecting an object on a railroad track at a level crossing.

BACKGROUND OF THE INVENTION

Conventional systems for detecting the presence of an oncoming train moving towards a level crossing for controlling the level crossing gate system have been relatively unsophisticated. Typically, a voltage between rails in an electrically isolated section is provided, and the conductive wheels of the train passing over the section allow for current to pass which is used to generate a signal for the level crossing gate system. While the reliability of such unsophisticated train presence detection systems is very high, the potential danger to human life by the failure of conventional systems makes it of paramount importance to provide detection apparatus which is as reliable as possible, if not 100% reliable.

In U.S. Pat. No. 4,179,744 to Lowe, a system for analyzing performance of electric traction motor powered railway locomotives is described in which the magnetic fields of electrical operating components of the electric traction motor powered vehicles are sensed. The results of the sensing are used for performance and maintenance evaluation purposes. While the speed of the train is obtained from the measurements, the system described measures the movement and operation of electrical operating components without providing useful information on the movement of vehicles containing no electrical operating components. While most trains in the United States have electric traction motors, it is possible for certain types of long freight trains to have locomotives in the middle or at the rear of the moving train. It is also possible for a train to have its traction motors turned off while still in motion. In the case that the locomotive at the front of the train is absent or turned off, detection of electrical operating components cannot be used as a reliable means for detecting the presence of a train moving towards a level crossing.

In U.S. Pat. No. 4,283,031 to Finch, a magnetic sensor for detecting the movement of a wheel of a rail car is described in which the speed and the direction of the rolling wheel can be determined. The wheel movement measurements from various sensors on each side of the level crossing are used to control the level crossing gate system. The wheel movement sensor disclosed in Finch is an active device mounted in close proximity to the moving wheel and is mounted above ground. By providing the sensor above ground and in a predetermined position adjacent the moving wheels of the train, the sensor is both exposed to the elements and exposed to risk of damage either by the train itself or by vandalism. The wheel sensor disclosed by Finch is not suitable for mounting at or below ground level.

SUMMARY OF THE INVENTION

It is an object of the present invention to provide a train presence detection apparatus which is able to detect the presence of ferromagnetic objects moving above ground with accuracy and reliability while safely housing the detection apparatus at ground level or buried below ground level so as to be protected and concealed from the elements, normal maintenance operations and vandals.

It is a further object of the present invention to provide a passive magnetic vehicle motion detector system able to distinguish between vehicle motion on adjacent tracks or lanes.

It is yet another object of the present invention to provide a train presence magnetic detection apparatus which is able to detect an object on a railroad track at a level crossing even if the object is stationary or slow moving.

According to the invention, there is provided a train presence detection apparatus for use with a level crossing gate system or other such warning system, the apparatus comprising: a passive magnetic detector provided at ground level or buried below ground level in between rails of a railroad track at a distance from the level crossing for detecting magnetic field disturbances caused by ferromagnetic objects passing overhead on the track; magnetic field reversal detection means connected to the passive detector for detecting reversals in a magnetic field detected by the passive detector and outputting a reversal signal; and train presence analyzer means for analyzing the reversal signal and outputting a train presence output signal. A magnetic reversal is a change in state or the change in sense in which a magnetic signal is changing by either increasing and then decreasing, or by decreasing and then increasing. It is not necessarily a change in net reversal of the signal through zero.

Preferably, the magnetic field reversal detection means are powered by a DC power line connected to the analyzer means and the reversal signal is an AC signal sent over the same power line. Preferably, the reversal detection means has a threshold of about 15 milligauss for generating the reversal signal.

In another aspect of this invention the AC signal uses one tone for a positive magnetic field change and another tone for a negative magnetic field change.

In yet a further aspect of this invention the train presence analyzer means outputs said presence signal when 2 reversals are detected within a period of about 5 seconds.

In an additional aspect of this invention a pair of passive magnetic detectors are provided for a pair of rails, said train presence analyzer means including means for comparing reversals from said magnetic field reversal detection means for each of said pair of passive magnetic detectors, and said train presence output signal indicates a track on which train presence is detected.

The invention also provides a vehicle motion detector circuit for analyzing at least one passive magnetic field detector output signal to generate a signal indicating a lane or track on which a vehicle is travelling and causing a disturbance in a magnetic field detected by the detector, the detector circuit comprising: analyzer means for analyzing the detector output signal to determine a sharpness thereof and for outputting the lane or track indicating signal, the sharpness being dependent on a proximity of the vehicle to the magnetic field detector while moving past, whereby the lane or track on which the vehicle is travelling is detected.

Preferably, the sharpness of the detector output signal includes a signal characteristic such as the frequency of polarity change in the signal, the intensity of the signal and the waveform shape. Also preferably, an alarm signal generator means is included for generating an alarm signal when a moving vehicle is detected which is on a track or lane closest to the detector but not when a moving vehicle is detected which is on a track or lane adjacent to the detector.

The invention further provides a stationary or slow moving train presence detection apparatus for detecting an object on a railroad track at a level crossing, the apparatus comprising: an array of magnetometer detectors provided at ground level or buried below ground level in between rails of the railroad track for detecting static magnetic field levels caused by ferromagnetic objects located overhead on the track at said crossing; recording means for recording, as recorded values, magnetic field level signal values from the detectors when no object is present on the track at the crossing; and train presence analyzer means for comparing signal values from the detectors to the recorded values and outputting a train presence output signal.

BRIEF DESCRIPTION OF THE DRAWINGS

The invention will be better understood by way of the following detailed description of a preferred embodiment with reference to the appended drawings in which:

FIG. 5 is a block diagram of the recording means and train presence analyzer circuit for the stationary or slow moving train presence detection circuit according to the preferred embodiment;

FIG. 6 is a system flow chart for the stationary or slow moving train presence detection system according to the preferred embodiment;

FIG. 7 is a schematic block diagram of the signal analyzing, self testing, and crossing warning control means which constitute the remainder of the central electronics located at the crossing;

FIG. 8 is a sensor location diagram for an optional island protection system for standing or very slow moving trains; and FIG. 9 is a schematic block diagram of said island protection system.

DETAILED DESCRIPTION OF THE PREFERRED EMBODIMENT

Figure 1:
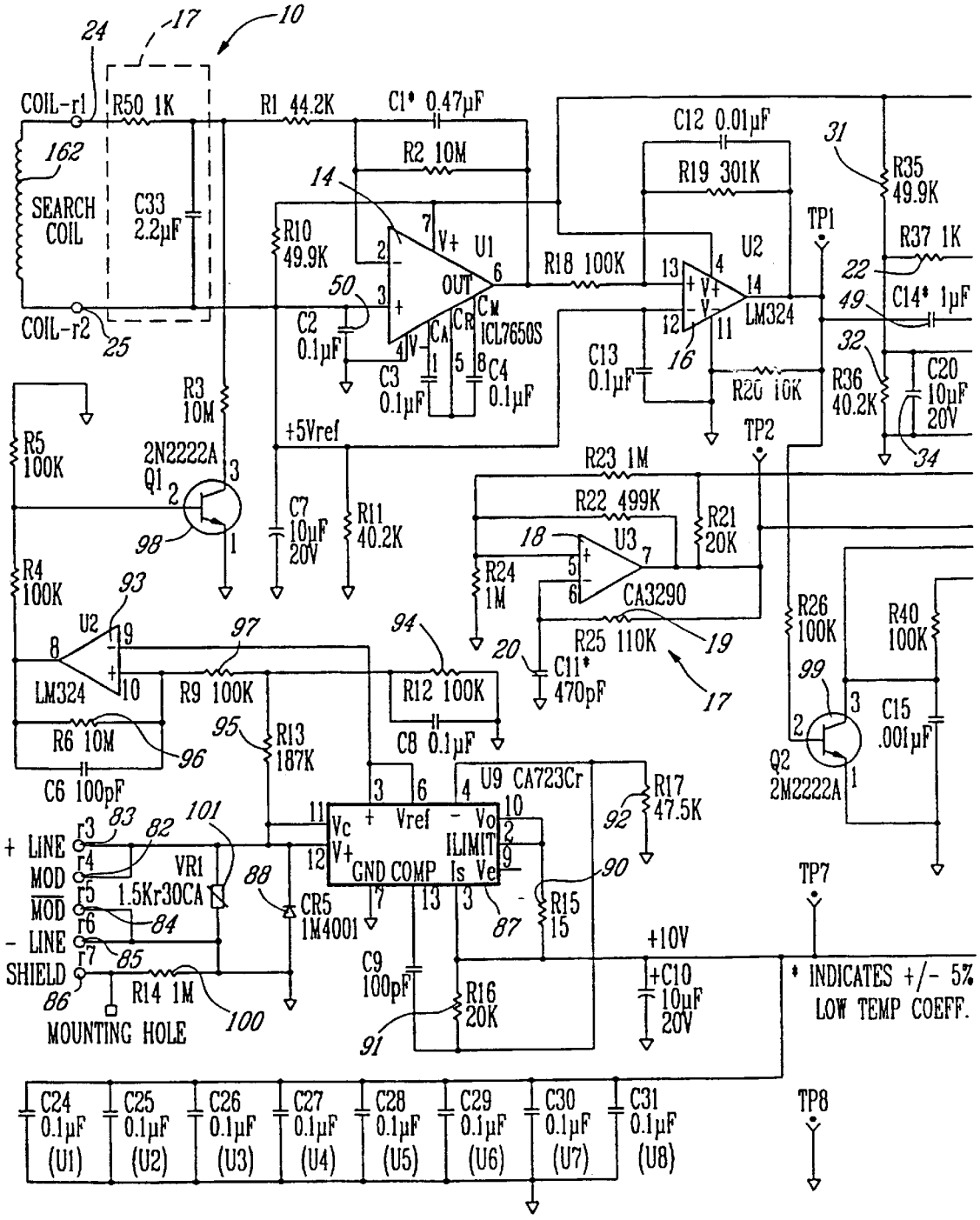
FIG. 1 is a schematic block diagram of the magnetic field reversal detection and train presence analyzer circuit according to the preferred embodiment.
Figure 1:
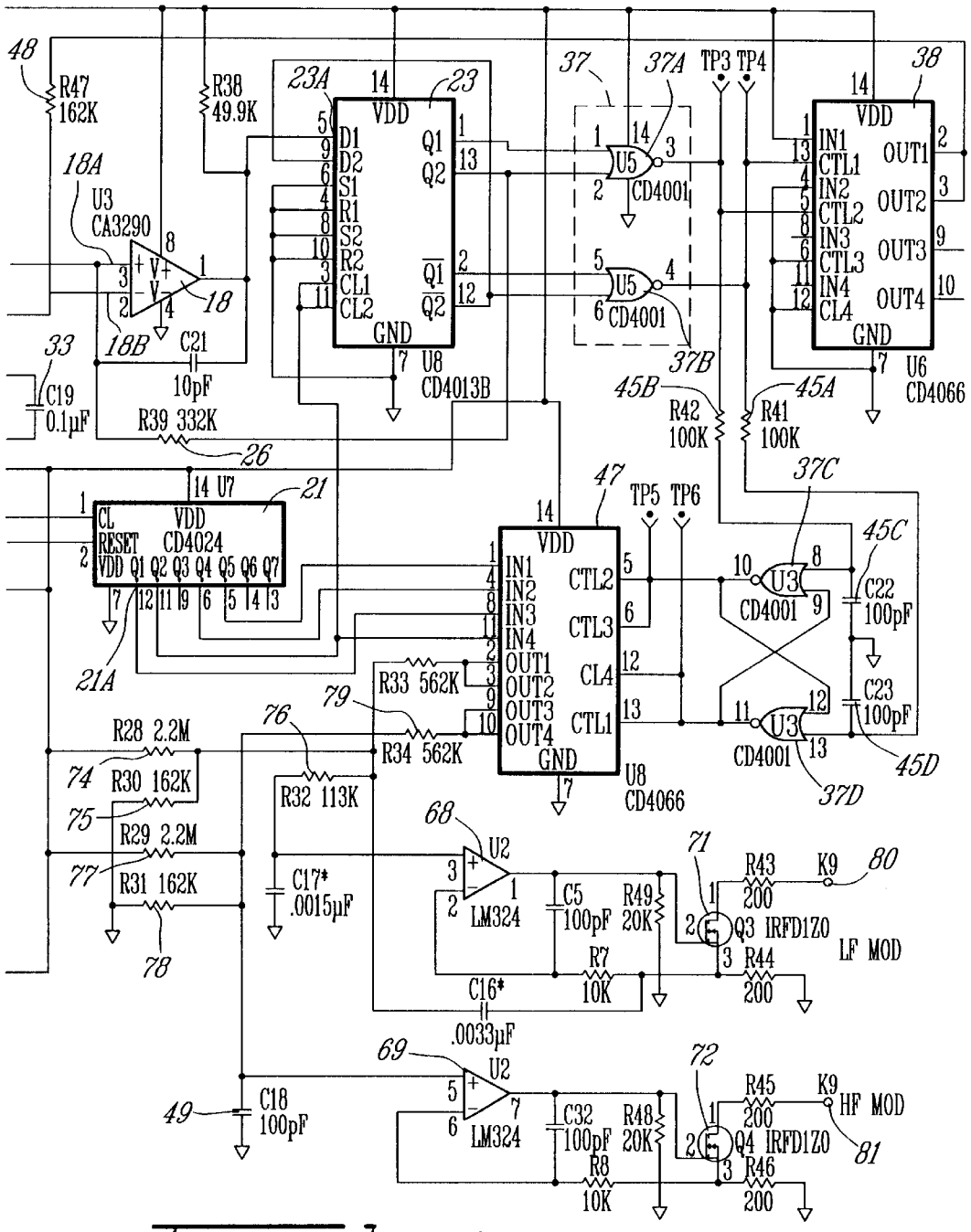
Figure 2:
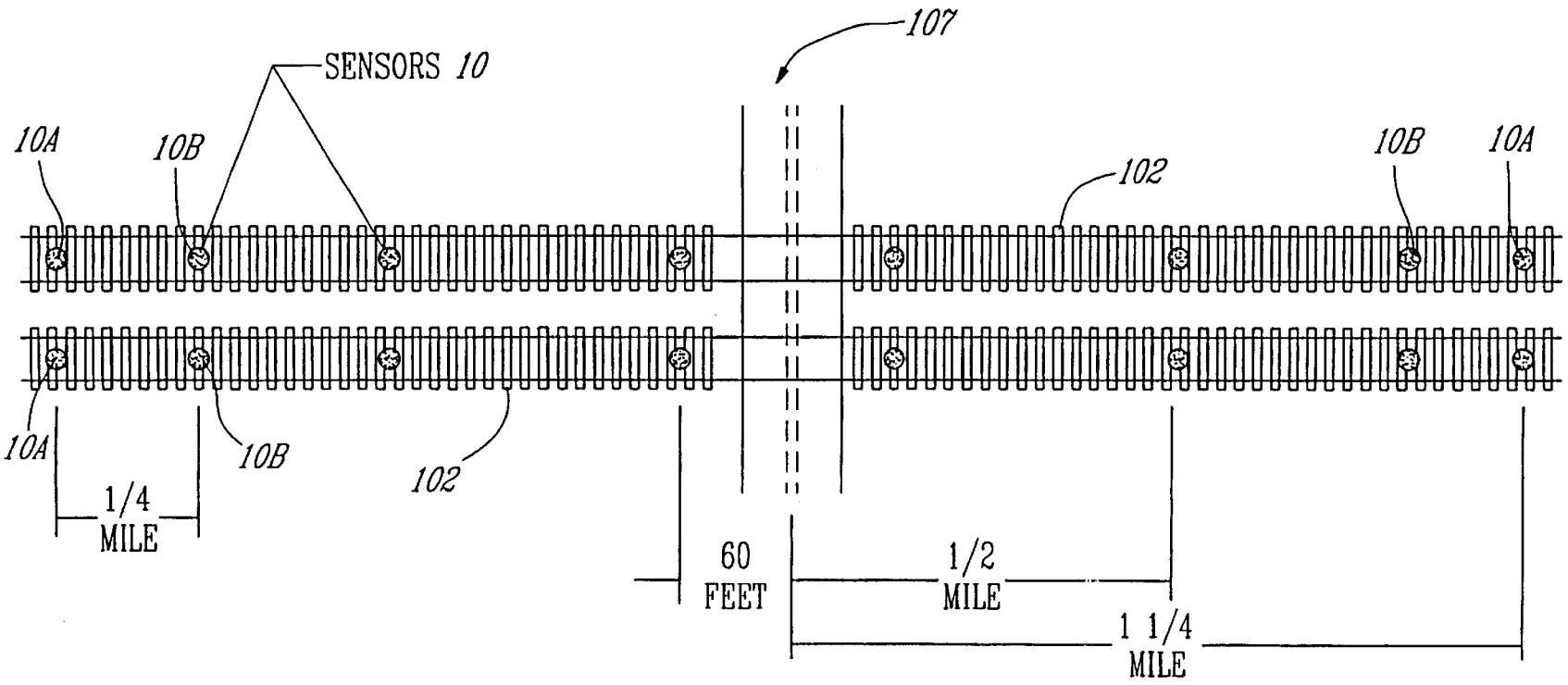
FIG. 2 is a layout diagram of a two track single crossing array.

The schematic diagram of the train presence detection circuit is shown in FIG. 1, and the layout of the installation is shown in FIG. 2. A passive "search" coil 10 is connected at terminals [E1]24 and [E2]25 consists of 5000 turns of number 32 AWG copper wire, having a mean diameter of 7.5 inches. The voltage induced in the coil 10 is filtered by network [R50-C33]11, and amplified by chopper-stabilized integrating operational amplifier [U1]14 and again by section [U2(D)]# of quad operational amplifier U2. Both operational amplifiers, and all other integrated circuits except [U9]83, operate from a 10 volt DC bus.

One section [U3A]# of dual comparator [U3]18 forms a clock oscillator with frequency determined by resistor [R25] 19 and capacitor [Cl 1]20. These components are selected to provide a clock frequency of approximately 8 kilohertz. This frequency is applied to the input of seven-stage binary counter [U7]21. Counter [U7]21 performs multiple functions which will be discussed in turn.

Output [Q1]22 of [U7]21, producing a 4 kilohertz square wave voltage, feeds the clock inputs of dual flip-flop [U4]23. Section 2 of [U4]23 is operated as a complementing or divide-by-two flip-flop connected output [Q2(not)]# to input D1. Output [Q2]# produces a 2 kilohertz square wave. The square wave is attenuated by voltage divider network [R39] 26 [R17]# to approximately 30 millivolts peak-to-peak, and applied to the positive input of the second section [U3B]# of comparator [U3]18. The 30 millivolt square wave rides on a DC reference voltage of approximately 4.4 volts, produced by network [R35]31 and [R36]32 and stabilized by capacitors [C19]33 and [C20]34.

The [D1]35 input of [U4]23 is driven by the output of U2B. two-input NOR gates, sections [A]37A and [B]37B of [U5]37, compare the states of the two flip-flops [U4]23. If the flip-flops are in opposite states (Q1 high and Q2 low or vice-versa), the output of both NOR gates is low. The NOR gates drive two control inputs 1 and 2 of analog switch [U6] 38. The analog switches remain in the OFF condition when the control inputs are low.

Since the D1 input of [U4]23 is controlled by the [U3B] # output, the flip-flops can toggle in opposite states only if that output changes state at the 2-kilohertz rate. This in turn requires that the [U3B]18B negative-input voltage be at a level between the limits of the voltage excursions at its positive input, or approximately 4.4 volts plus or minus 15 millivolts.

If the [U3B]18B negative-input voltage is lower than the minimum positive-input voltage, the [U3B]# output remains high and flip-flop 1 of dual flip flop 23 remains in the Q1 state, so that Q1 (not) is low. When flip-flop 2 of dual flip-flop 23 is in the Q2 state, Q2(not) is also low, making the output on pin 4 37B of [U5]37 high. Control input 1 of analog switch [U6]38 is then high, turning on the switch and applying 10 volts to one terminal of feedback resistor [R47] 48. Current through [R47]48 charges capacitor [C14]49 (which is connected between the [U3B]18B negative input and the output of operational amplifier [U2D]) during the 500-microsecond interval in which [Q2](not)# remains low. The charge delivered is sufficient to change the voltage on [C2]50 by approximately 15 millivolts, or half of the 30-millivolt excursion range of the [U3B]18B positive input. Thus, the condition is re-established by which both flip-flops toggle and maintain opposite states.

If the [U3B]18B negative-input voltage is higher than the maximum positive-input voltage, the U3B output stays low. [Q1]98 stays low, and analog switch 2 # of [U6]38 is turned on when [Q2]99 is low. Switch 2 38A connects [R47]48 to common rather than to 10 volts, and charge is bled from [C14]49. This lowers the voltage on the [U3]18 negative input and again establishes the toggling condition.

It can be seen that the circuit acts to oppose any change of the voltage at the [U3]18 negative input. Therefore, when a magnetic influence acts on the search coil 10 and produces a voltage change at the output of [U2D]#, the circuit adds or subtracts charge to cancel the change. The sense in which the field is changing determines whether [U6]38 analog switch 1 # or 2 # is activated, and thereby provides an indication of the sense. The sensitivity is set by the half-amplitude of the square-wave perturbations at the [U3B]18B positive input (15 millivolts) and the gain of the integrator and amplifier, and is set to be approximately 15 milligauss in the preferred embodiment.

The outputs of the aforementioned NOR gates 37A and 37B are applied to the two inputs of a set-reset flip-flop comprised of the two remaining NOR gates C # and D # of [U5]37. Filter networks [R42]45B, [C23]45D and [R41]45A, [C22]45C prevent spurious triggering of the set-reset flip-flop 37Dand 37C by transient voltage spikes which may occur during transitions of the flip-flop 37D and 37C outputs of [U4]23. The state of the set-reset flip-flop 37D and 37C is determined by the last output from the NOR gates 37D and 37C, and hence on whether [C14]49 was last charged or discharged.

The outputs of the set-reset flip-flop 37D and 37C are applied to the control inputs of quad analog switch [U8]47, with U5C controlling switches 2 and 3, and U5D controlling switches 1 and 4. Switch 1 connects to the 250-hertz square wave present on the Q5 output of [U7]21, switch 2 to the 500-hertz square wave at the Q4 output of [U7] 21, switch 3 to the 4 kilohertz square wave at the Q1 output of [U7] 21, and switch 4 to the 2 kilohertz square wave at the Q2 output of [U7] 21.

Operational amplifier sections [U2A]68 and [U2B]69, in conjunction with field-effect transistors [Q3]71 and [Q4]72, comprise modulators for superimposing carrier-frequency information on the current drawn by the sensor. Amplifier [U2A]68 and transistor [Q3]71 constitute a two-pole Butterworth active filter and transconductance amplifier with a cutoff frequency of approximately 665 hertz and a current output at the drain of [Q3]71 of 5 milliamperes per volt of in-band input. Resistors [R28]74, [R30]75 and [R32]76 establish a voltage swing of approximately 0.6 to 2.6 volts at the filter/amplifier input when the output of analog switches 1 # or 2 # swing from zero to 10 volts; the corresponding output current swing is from 3 to 13 milliamps. This swing provides the plus-or-minus 5 milliamp excursions which comprise the desired modulation level, while maintaining a current flow at all times to insure linearity (i.e., class A amplification).

If output U5C of the set-reset flip-flop 37C and 37D is high, switch 2 of U8 is closed and a 500 hertz square wave is applied to the input of the filter/amplifier [U2A-Q3]. If output U5D is high, switch 1 is closed and a 250 hertz square wave is applied to the input of filter/amplifier U2A-Q3.

Similar actions take place at the second filter/amplifier [U2B-Q4]69 and 72. In this case, a high condition at [U5C] 37C produces a 4-kilohertz output, and a high condition at [U5D]# produces a 2 kilohertz output. In lieu of the Butterworth active filter configuration used for [U2A-Q3]68 and 71, the circuit for [U2B-Q4]69 and 72 uses a simple passive resistance-capacitance lowpass network consisting of [C18] 49 and the equivalent Therein resistance of the network [R29]77, [R31]78, and [R34]79, which yields a cutoff frequency of approximately 13 kilohertz. The flat passband and sharp cutoff of the Butterworth filter is necessary to prevent harmonics of the lower two frequencies from interfering with those of the upper two frequencies, when two sensors are used on a line. Harmonics of the upper frequencies do not materially affect system operation, so that the filtering requirements are less stringent.

When a sensor is installed as part of a system, either the upper or lower modulation register must be selected. This is accomplished using a field-installed jumper from either the [E8]80 (LF MOD) or [E9]81 (HF MOD) terminal to the positive line via terminal [E4]82 (MOD). The unused terminal [E9]81 or [E8]80 is left open or tied to the negative line at terminal [B5]82 (MOD not). This disables the unused modulation channel.

Surge protector [VR1]101 and diode [CR5]88 protect the sensor against voltage transients or line polarity reversal. The input voltage, which must be in the range 13–28 volts, is applied to voltage regulator [U9]87. The internal 7-volt reference of [U9]87 is compared with its output voltage via voltage divider [R16]91 and [R17]92, which establish the 10-volt bus level for the remaining integrated circuits. Resistor [R15]90 samples the current and allows [U9]87 to limit its output to about 40 milliamperes as a protective measure.

The 7-volt reference is also fed to the negative input of amplifier [U2C]93, used as a comparator. The positive input of [U2C]93 is fed from voltage divider [R12]94, [R13]95, with [R6]96 and [R9]97 providing a small amount of hysteresis to facilitate reliable output transitions. When the line voltage is raised above approximately 20 volts, the output of [U2C]93 goes high, turning on transistor [Q1]98 and drawing a small current (approximately ½ microampere) from the search coil 10 and via its input filter network [R50-C33]11. If the search coil 10 is present and has its normal resistance of 1600 ohms, the output amplifier [U2D]93 then decreases by approximately 1 volt with a 5-second time constant. Thus, by controlling the time for which the line is held above 20 volts, an output of the desired level may be produced at [U2D]93, and the sensor response may be checked to see that one or two reversal events result. This constitutes the self-test function.

If the search coil 10 is shorted, the voltage change at [U2D]93 will be absent or greatly attenuated. If, on the other hand, the coil is open, [U1A]14 will saturate at its upper voltage limit and [U2D]93 at its lower voltage limit.

When the voltage at the output of [U2D]93 falls below approximately 0.7 volts, transistor [Q2]99, which is normally conducting, cuts off. The collector of [Q2]99 is connected to the RESET input of binary counter [U7]21. When [Q2]99 cuts off, the counter is held in the reset mode and produces no square-wave outputs; thus, modulation is inhibited and the sensor does not produce a carrier signal. The disappearance of the carrier during self-test thus indicates an open search coil. [Q2]99 also acts to cut off the carrier if a magnetic disturbance is large enough to saturate [U2D]93 in its low state. This provides an indication that the dynamic range of the sensor has been exceeded. While the preferred embodiment does not include a similar feature for positive saturation of [U2D]93, the addition of such a circuit could readily be accomplished.

As a precaution against noise pickup and to provide additional protection against voltage transients due to nearby lightning strikes. It is desirable that the two-wire line to the sensor be shielded, and that the shield not be used as an active conductor. A terminal [E7]86 and resistor [R14]100 are included to provide a means for preventing any charge buildup between the sensor circuitry and the shield. Internal shielding of the sensor assembly is also connected to [E7]86. The shield should be connected to a good earth ground at the central logic controller.

As shown in FIG. 2, sensors 10 are provided in pairs starting 1¼ miles from the crossing under both sets of parallel track 102. Of course, if the configuration is for a single track, coil pairs are not required. The outermost search coils 10A are spaced by a ¼ mile with respect to the second pairs of search coils 10B. The second pairs of search coils 10B confirm the presence of an oncoming train and are used to confirm the speed of the train by measuring the time difference between passing over the outermost pairs of search coils 10A to the time of passing over the second pair of search coils 10B. The speed of approach of the oncoming train is taken into consideration for the purposes of timing the control of the level crossing gate system or other such warning system. For example, a very high speed train would cause the level crossing gate system to begin flashing the warning lights and close the gate almost immediately whereas a slow moving train may cause the train presence detection system to wait until the train crosses the ½ mile sensors or an appropriate time period depending on the speed before beginning to close the gate at the level crossing.

Figure 3:
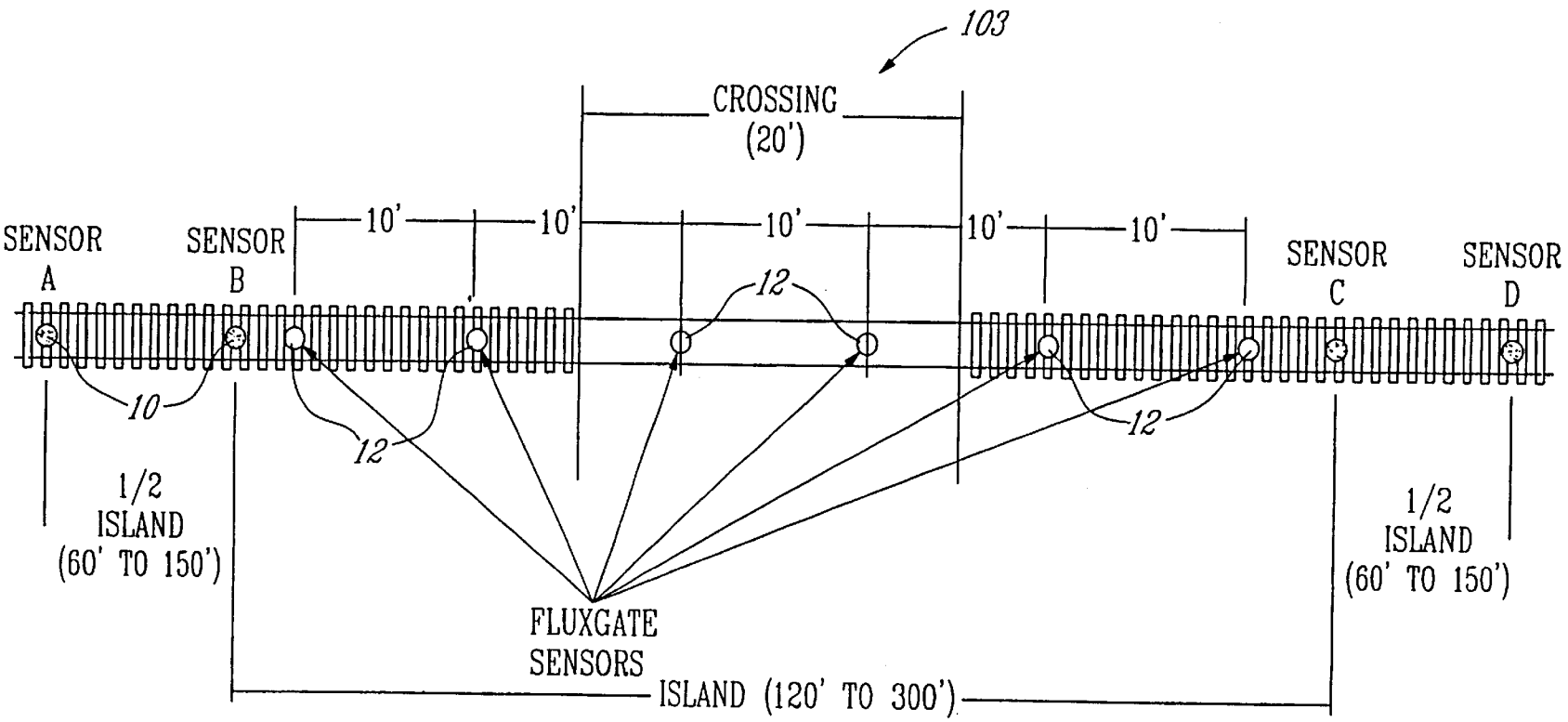
FIG. 3 is an enlarged view of the layout shown in FIG. 2 showing details of flux gate sensors installed at the level crossing and level crossing island.

As illustrated in FIG. 3, most level crossings 103 include an island of about 120 ft. to 300 ft. whereas the actual road surface at the point of crossing is typically about 20 ft. to 40 ft.. According to the invention, six flux gate sensors 12 are provided at 10 ft. intervals to span a distance of about 50 ft. The number of flux gate sensors 12 and the span of the linear array of flux gate sensors 12 may be greater. The flux gate sensors 12 are magnetometer devices which measure the level of magnetic field at various points at the ground level along the track. By measuring and recording the magnetic field values when no train is present, a comparison of the field values when the gates are down can be compared to the recorded values. This determines with maximum security that all train cars have left the level crossing and that no stray vehicle has been left or has moved onto the level crossing island. Of course, by using an array of magnetometers and comparing signal values from the magnetometer detectors of all of the flux gate sensors 12, it is possible to determine whether a large ferromagnetic object is present over the railroad track. Such a large object will affect the readings of the flux gate sensors 12 over a number of sensors and such variations with respect to the prerecorded values can be analyzed to ascertain with confidence that a vehicle is present on the track at the island. As can be appreciated, the detection of a stationary vehicle on the island can result in an emergency service call to despatch a crew to the level crossing in order to ensure that the stationary rail vehicle is removed from the island and safely returned to its place so that the level crossing can be cleared.

Preferably, the flux gate sensors 12 are read and recorded as soon as the gate is lowered. This occurs, as mentioned above, a some point in time after the outermost search coils 10 indicate that a train is approaching. The memory storing the recorded values may also contain the recorded values from previous "clear" readings. It is possible for the magnetic field readings to change over time, as for example if rails are left on the side of the tracks near the island. If the flux gate sensor 12 values read after the train leaves the island are consistent with the "historical" "clear" values, but not the values read when the crossing gate was lowered, it may be decided to raise the crossing gate (or deactivate the warning system). Of course, if the historical values are not consistent with the latest clear values, and the sensor values after the train leaves the island are consistent with the latest clear values, the crossing gate will be lifted, and the latest clear values will be assigned to the historical values.

As can also be appreciated, the present invention provides a detection system for adjacent parallel tracks 102 FIG. 2. In the arrangement illustrated in FIG. 4, the pair of search coils 10 and magnetic field reversal detection circuits 104 communicate over a long distance power line 105 to a train presence analyzer circuit shown in FIG. 4 as the frequency discriminator and error detection logic array integrated circuit 106. Since passive search coils 10 receive a considerable readable signal from moving rail vehicles on the adjacent track, it is important to be able to distinguish between moving rail vehicles on different tracks. In the preferred embodiment, this is done by comparing the number of reversals detected in each of the search coils 10. If one search coil 10 detects fewer reversals than the number of reversals detected by the other coil on the other track, it is presumed that the one track does not have a moving train on it. The object of this detection system is to prevent the possibility of an oncoming train approaching the level crossing 107 FIG. 2 undetected by being masked by the presence of a train on the adjacent track moving away from the level crossing 107. The train presence detection system according to the preferred embodiment solves this problem by comparing reversals detected at each pair of search coils 10.

As can be appreciated, a single passive coil provided at one track is able to detect the movement of ferromagnetic vehicles passing along an adjacent track, however, analyzer circuitry may be provided to determine a sharpness of the passive coil detector output signal to determine whether the vehicle is moving in the same track or on an adjacent track. The sharpness of the detector output signal can be measured by the number of reversals or the frequency of reversals as well as the intensity and waveform of the passive coil detector output signal.

As shown in FIG. 5, the preferred embodiment provides a sensor interface board 108 connected to each of the four search coils 10, or pairs of search coils 10, as well as a flux gate interface board 109 connected to each of the six magnetometer detectors 12 spaced at 10 ft. apart. A single logic and control data processor 110 receives the reversal data and the flux gate reading data and processes this information to control the level crossing gate. The data processing and decision making logic of the logic and control board 110 illustrated in FIG. 5 is illustrated in FIG. 6.

Figure 4:
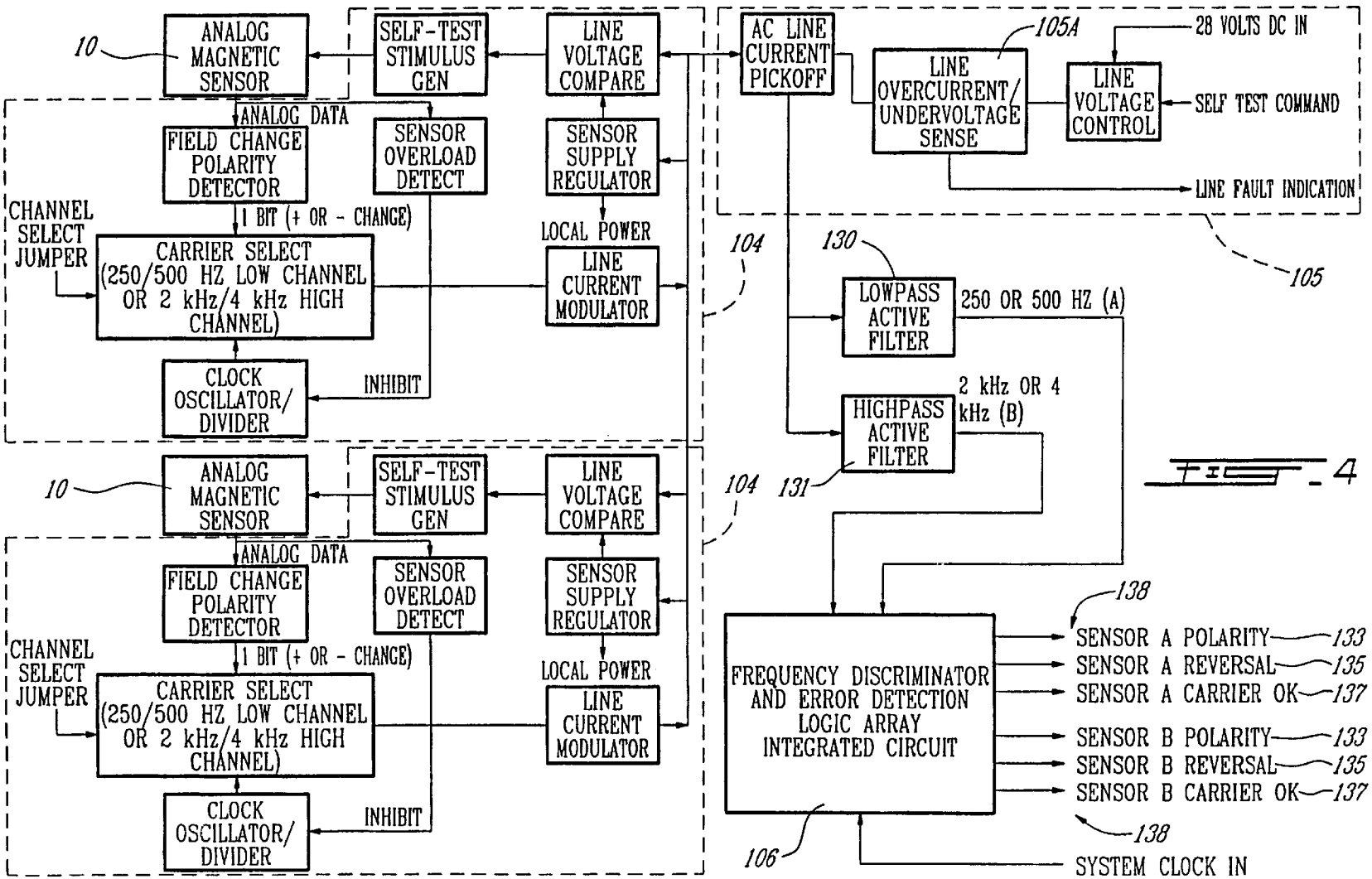
FIG. 4 is a schematic block diagram of the system shown in FIG. 1.

In the arrangement illustrated in FIG. 2, each pair of sensors 10A, consisting of magnetic sensing means and associated reversal-detection circuitry, receive power and communicate over a single twisted-pair wire line to a communication and power interface located centrally at the crossing. FIG. 4 shows a schematic block diagram of a pair of sensors 10 and the associated central circuitry. One sensor is programmed via a jumper connection to operate at the higher carrier frequency (2 and 4 kilohertz in the preferred embodiment), and the other sensor is programmed to operate at the lower carrier frequency (250 and 500 hertz). and The carrier frequency signals generated by the two sensors are separated by active lowpass filter 130 and highpass filter 131 and are routed to the frequency discriminator and error detection logic circuitry 106.

The latter circuitry senses whether the individual carrier frequencies are in their upper states (4 kilohertz and 500 hertz) or their lower states (2 kilohertz or 250 hertz) and provides three logic outputs for each sensor. The polarity output 133 indicates the present sense of field change (positive going or negative going); the reversal output 135 provides a pulse at the instant of a each reversal; and the carrier OK 137 output is true if and only if the carrier frequency is present and within the specified frequency limits. The latter output provides a means for verifying the integrity of the power line to the sensor and its proper operation (to the extent that it generates a carrier frequency in the proper range).

Power is supplied to the sensors via line voltage control circuitry 105 which furnishes the proper line voltage under quiescent conditions (approximately 16 volts in the preferred embodiment), and upon self-test command from the control means, increases the voltage to a higher level (approximately 24 volts in the preferred embodiment) in order to initiate the self-test function of the sensors. The power interface # also includes overcurrent and undercurrent sensing circuitry 105A, which provides a fault indication to the control means in the event of a short circuit in the line to the sensors, or a sensor failure resulting in excessive current drain.

Since each communication and power control interface circuit accommodates two sensors, the number of such circuits required for a given system is one-half of the total number of sensors. It would be possible to multiplex more than two sensors on one line with a corresponding saving of wire and interface circuitry, but there are several factors which favor limitation of the scheme to two sensors: a) The robustness of the communication link decreases as the number of sensors (and hence the required bandwidth) increases; b) the DC voltage drop in the line increases due to the increasing aggregate sensor supply current; and c) overall system reliability decreases because failure of a single line inactivates a larger portion of the sensor array.

FIG. 7 shows a schematic block diagram of the control means which accepts the outputs of the various interface circuits, controls the crossing protection means on the bases of the responses therein, and provides for fail safe operation of the overall system. The polarity and reversal outputs are fed to the train discrimination logic, which operates as follows: a) Determines that the observed reversal activity constitutes train presence; b) determines speed on the basis of the time of activity at successive sensors and thereby specifies when to declare the crossing unsafe, with adequate warning time for traffic and pedestrians to clear the crossing; c) Determines train direction on the basis of the sequence in which sensors detect activity; d) Determines which track the approaching train occupies, and monitors for the approach of a second train on an adjacent track during passage of the first; and e) Declares the crossing safe when no activity exists at any sensor and the sequence of activity in the sensor array indicates that it is not possible for a train of short length to be in transition between the outer and inner sensors.

The methodologies for performing b), c) and e) are straightforward, but those of a) and d) require comment. Drifts in circuit conditions due to leakage currents and temperature changes, and magnetic transients due to lightning or power line disturbances, may result in occasional spurious indications of magnetic activity (usually an isolated reversal). Therefore, it is necessary to set a minimum level of activity which must be attained before train presence is declared. In the preferred embodiment, three reversals in a five-second period constitute train presence, and a five second period with no reversals is necessary to declare lack of presence after it has been detected. The latter time may be reduced in the case of the sensors adjacent to the crossing in order to minimize waiting time, provided that the train speed has been determined to be high enough to guarantee clearing in the shorter period.

With regard to d), the case of a multiple-track crossing poses special problems due to the geometry and magnetic properties peculiar to railroads. Locomotives and cars, and their associated magnetic dipoles, are long compared to the spacing between tracks. Therefore, sensors under one track will inevitably be influenced to some degree by equipment passing on an adjacent track. Furthermore, there is a wide range in the amplitude of magnetic signatures, so that certain types of rolling stock may produce larger fields at a sensor on an adjacent track than light equipment directly over the sensor. Thus, information from a single sensor cannot localize the train to a single track, or prevent the masking of an incoming train by the presence of an outbound one on an adjacent track.

Localization to a single track may be accomplished if the detailed structure of the magnetic signature is taken into account. Railroad cars and locomotives are characterized by a complex assemblage of ferromagnetic parts having relatively short lengths (e.g., wheels and axles), and others which are much longer (e.g., supporting beams). Cargo may contribute features ir both categories, end locomotives exhibit fields related to traction motor activity, which tend to fall in the short-dipole category.

Since the field from a magnetic dipole drops off as the cube of the distance for distances larger than about one dipole length, it is the long dipole which predominate in influence at adjacent tracks. In addition, the fields which do exist from shorter members tend to blur into much less complex variations than those that exist in the immediate vicinity of the passing equipment. In terms of the reversals in the sense of change of the observed magnetic fields, the number of reversals over the length of a particular car or locomotive, or of a group thereof, is considerably greater for a sensor under the equipment than for a sensor on an adjacent track. Thus, a comparison of the reversal activity between adjacent tracks enables localization to one or the other, and allows the presence of an incoming train to be detected in the presence of an outbound one. It should be noted, however, that over a distance small compared to the length of a car, it is possible for a reversal to occur on the adjacent track without a corresponding reversal on the active track.

In the preferred embodiment, the method for track localization operates as follows: When a train has been detected on a given track (using the criterion of a) above), adjacent sensors are monitored, and a second train is declared present if three or more reversals are determined in a one-second period, or if the number of reversals in the same period on the adjacent track exceeds those on the active track by more than one. These are empirically determined criteria based on analysis of train magnetic signatures, with the aim of minimizing the methods complexity while assuring reliable detection; more complex schemes are obviously possible and may be required for some installations.

It is well known in the art that multiple axis (two or three axis) magnetometers may be used to extract additional information regarding vehicle signatures which is not available from single axis types. Although the embodiment described herein is based on single axis magnetometers, multiple axis magnetometers may be also be employed and will contribute usefully to track localization; however, due to the aforementioned geometry and magnetic complexity of rail equipment, the associated methods for extracting the data are apt to be much more complex than those described herein.

The output of the train discrimination logic 140 FIG. 7 is a CROSSING SAFE signal 140S which exists only if all of the relevant criteria confirm that no train can reach the intersection within the required warning time (typically 30 seconds). It forms one of several inputs to the master warning-control function, which in FIG. 7 is depicted as a multiple-input NAND gate 139. It should be understood that such depiction merely serves as a logical representation, and that the actual circuitry involved may have other forms, such as a series concatenation of relay contacts, and may also involve redundant paths in order to improve reliability.

A second input 142S to the NAND gate 130 comes from the self-test functional block in FIG. 7. The circuitry therein accepts the reversal 133, carrier OK 137, and line fault signals 142S from the sensor interface 106 of FIG. 4, and a self test command 144S from the timing circuitry 144. If the carrier OK signals 137 are not present, or if a line fault is indicated, the SENSORS OK output to the NAND gate 139 disappears and the crossing is declared unsafe. In addition, the SENSORS OK signal is routed to a second NAND gate 146, which in the absence of SENSORS OK generates a TROUBLE signal 146S that may be utilized to activate an alarm light on the control equipment enclosure, or to route an error message via existing railway communication links.

In FIG. 7, the master clock is a crystal oscillator which drives a self-test timing counter chain and also furnishes the time base for the train discrimination and interface circuits. Activity of the counter chain is monitored by watchdog circuitry 148, which contains an independent oscillator and timing chain. If the master timing circuitry 144 fails or deviates significantly from its proper behavior, the TIMING OK signal 144S to both NAND gates 146 and 139 disappears, thus declaring the crossing unsafe 139S and activating the TROUBLE signal 146S. Additional NAND gate inputs are controlled by a power supply voltage sensing circuit and are true only if all voltages are within acceptable limits.

The optional island protection system discussed at some length above is configured as a stand-alone system which can be used in conjunction with the above described crossing protection system, or as an adjunct to an existing crossing and island protection system. The island 151 FIG. 8 (a railroad term for a protected zone associated with a crossing) spans the crossing and is typically defined a being 120 to 300 feet in length, as compared to 20 to feet for the actual width of the road constituting the crossing 153. The terms crossing, level crossing and grade crossing are used synonymously herein. In accordance with the invention, an array of static magnetometers are provided at suitable intervals over the span of the island. (A static magnetometer 12 is one which responds to non-varying as well as varying fields and is thus capable of detecting stationary equipment. A common type of static magnetometer is the fluxgate, which is used in its single-axis form in the preferred embodiment; however, it should be understood that other types could be employed, provided that the sensitivity and resolution capability required for the application is present).

Orientation of the sensitive axis of the magnetometers with respect to the track is not critical, but it has been found that placing the axis perpendicular to the track and more or less in a horizontal plane offers a reasonable compromise between fast release of the gate or warning signal when a train exits the island, and "holes" in the signature which could result in a car on the island being missed. Obviously, multiple axis magnetometers could be used and all axes examined for signature information, but as in the case of the track localization problem discussed above, the methods needed would be considerably more complex.

It has been found that a static magnetometer 12 spacing of about 15 feet assures that at least one magnetometer 12 will detect a significant change from the ambient magnetic field level if equipment is present in the island. Thus, as shown in FIG. 8, the number of magnetometers is chosen to permit spacing at approximately that interval. The outermost static magnetometers 12 may be inside the island limits at about half the characteristic spacing (7.5 feet3. The spacing may vary according to local circumstances. In FIG. 8, an array of only six magnetometers 12 and a short island are depicted in the interest of drawing clarity.

Also shown in FIG. 8 are magnetometer activity sensors 155 located outside of the island limits (preferably by approximately 50 feet). These sensors 155 detect that the entry of a train into the island is imminent, or that one has just departed, and may be of the search coil type described in the present disclosure; if the island protection system is used in conjunction with the overall crossing protest on system described above, the sensors 10 nearest the island in FIG. 2 may be located so as to serve the entry/exit detection function for the island protection system.

A schematic block diagram of the island protection system is shown in FIG. 9. The centrally located portion of the system consists of the activity sensor interface circuitry 157, the logic and control circuitry 159, and the fluxgate interface circuitry 160. The activity sensor circuitry 157 monitors the two sensors 155 FIG. 8 immediately outside of the island 151 and transmits a logic signal 157A or 157B indicating train movement to the logic and control circuitry 159. In effect they act as approach monitors. The analog inputs from the several fluxgate magnetometers 12 are passed through active-filter 160A signal conditioning active filters with a bandwidth on the order of 10 hertz, in order to provide rejection of spurious magnetic field changes. The several filtered signals are fed via a multiplexer to an analog-to-digital converter 160B, which in turn feeds the digitized fluxgate magnetic field information to the static random access memory (SRAM) 160C. Memory in/out, analog to digital conversion, and multiplexer channel select operations are controlled by the logic and control circuitry.

Operation of the system is as follows: When the main system of FIGS. 1,2,4, and 7, or the corresponding "approach" circuitry using existing railroad technology, determines that the gates should be lowered and/or the warning signal activated, the corresponding signal (GATE DOWN) is communicated to the island protection logic and control circuitry. The latter circuitry thereupon commands the fluxgate interface circuitry to continuously sample and store the digitized field levels of the various fluxgate sensors. (Due to the limited bandwidth of the signal conditioning circuitry, the necessary sample rate can be quite low by contemporary standards; the sampling theorem, familiar to those skilled in the art requires only 20 samples/second from each fluxgate magnetometer in order to fully utilize the information contained in the output of the signal conditioning circuitry.) If the sampling continues long enough to fill the memory, the earlier samples are discarded and only the more recent saved.

The sampling process continues until activity is detected at activity sensors 155 A or B, depending on the direction of train passage. Activity or readings at activity sensors 155 A or B is transmitted to logic and control circuitry 159 by the activity sensor interface circuitry 157. The sensors 155 A and B in effect generate a train approach or the train is about to enter the island when approaching or on the other hand a signal that the train has just left the island depending on the circumstances. At this time sampling is halted and only the last sample set, or preferably an average of the last several sets, are used. The purpose here is to sample at the last possible opportunity, after there has been time for the gates to come down and all traffic flow across the intersection to cease, to establish a "baseline" sample of the readings at each fluxgate magnetometer. (This baseline takes into account differences in the ambient magnetic environment of the several fluxgate magnetometers, as well as differences in individual sensitivity and zero-field offset). Earlier samples might be contaminated by last minute traffic at the intersection, and later ones by entry of the train into the island.

With the baseline established, the crossing protection logic and control circuitry waits until activity has occurred and then ceased at the other activity sensors 155 B or A, indicating that the train has passed over sensors 155 B or A and is no longer within the island limits. This in effect is an all clear signal from activity sensors 155 B or A It then commands the acquisition and storage of a new sample set or group of several sample sets, and compares these with the baseline established before the train entered the island. The values for the before-passage and after-passage samples for each fluxgate magnetometer 12 are then compared. If the individual differences are all within a defined threshold level (plus or minus 15 milligauss in the preferred embodiment), the GATE RELEASE output permits the gate to open and/or the warning signal to deactivate at the discretion of the main crossing protection system. If, however, one or more fluxgate sensors 12 detect an over-threshold difference in the before- and after-passage readings, it is assumed that equipment is present in the island, and the GATE RELEASE output prevents the gate from rising and/or the warning signal from being deactivated, even though the main system has declared the crossing safe. Sampling continues and the GATE RELEASE output inhibited, until the all fluxgate 12 readings fall within the permitted band. The system then resets and awaits a new passage.

Although a single track island protection system has been depicted, the invention is easily adapted to multiple tracks. Since the approach system has already identified the track in use, the island protection system does not need to so discriminate, and a single array of sensors placed between two tracks can serve for both.

Although the invention has been described hereinabove with reference to a preferred embodiment, it is to be understood that the scope of the invention encompasses a variety of embodiments of the invention as defined in the appended claims.

What is claimed is:

1. A train presence detection apparatus for use with a level crossing warning system, the apparatus comprising:

at least one passive magnetic detector provided at ground level or buried below ground level near rails of a railroad track at a distance from said level crossing for detecting a plurality of magnetic field disturbances caused by ferromagnetic objects passing overhead on said track;

magnetic field reversal detector connected to said passive detector for detecting reversals in a magnetic field detected by said passive detector and outputting a reversal signal; and train presence analyzer analyzing said reversal signal and outputting a train presence output signal.

2. The apparatus as claimed in claim 1, wherein said reversal detector is powered by a DC power line connected to said analyzer, said reversal signal being an AC signal sent over said power line.

3. The apparatus as claimed in claim 2, wherein said AC signal comprises one tone for a positive magnetic field change and another tone for a negative magnetic field change.

4. The apparatus as claimed in claim 2, wherein said reversal detector has a threshold of about 15 milligauss for generating said reversal signal.

5. The apparatus as claimed in claim 2, wherein said train presence analyzer outputs said presence signal when 2 reversals are detected within a period of about 5 seconds.

6. The apparatus as claimed in claim 2, wherein said passive magnetic detector comprises a linear array of search coils, said linear array including a first outermost coil at approximately 1.25 miles from said level crossing, a second of said coils at approximately 1 mile from said crossing, said train presence analyzer means including means for determining a speed of an oncoming train for adjusting a timing of activation of said level crossing warning system.

7. The apparatus as claimed in claim 1, wherein said reversal detector has a threshold of about 15 milligauss for generating said reversal signal.

8. The apparatus as claimed in claim 1, wherein said train presence analyzer outputs said presence signal when 2 reversals are detected within a period of about 5 seconds.

9. The apparatus as claimed in claim 1, wherein a pair of passive magnetic detectors are provided for a pair of rails, said train presence analyzer including means for comparing reversals from said magnetic field reversal detection means for each of said pair of passive magnetic detectors, and said train presence output signal indicates a track on which train presence is detected.

10. The apparatus of claim 1 in which the passive magnetic detector is provided in between the rails.

11. The apparatus as claimed in claim 1, wherein said passive magnetic detector is a coil.

12. The apparatus as claimed in claim 1, further comprising communication and power control interface circuitry which can control and power at least two passive magnetic detectors and magnetic field detection circuits.

13. The apparatus as claimed in claim 1, wherein said train presence analyzer means outputs said presence signal when at least three reversals are detected in a five second period.

14. The apparatus as claimed in claim 1, wherein said train presence analyzer means outputs a no train present signal when at least three reversals are detected in a five second period.

15. The apparatus as claimed in claim 1, wherein said passive magnetic detectors are multiple axis magnetometers.

16. The apparatus of claim 15 in which the passive magnetic detector is provided in between the rails.

17. A vehicle motion detector circuit for analyzing at least one passive magnetic field detector output signal to generate a signal indicating on which one of a plurality of lanes or tracks a vehicle is travelling and causing a disturbance in a magnetic field detected by said detector, the detector circuit comprising: an analyzer analyzing said detector output signal to determine a sharpness thereof and for outputting said lane or track discriminating indicating signal, said sharpness being dependent on a proximity of said vehicle to said magnetic field detector while moving past, whereby the lane or track on which said vehicle is traveling is detected.

18. The circuit as claimed in claim 17, wherein said sharpness of said detector output signal includes signal characteristics selected from the group of frequency of polarity change, intensity and waveform shape.

19. The circuit as claimed in claim 17, further comprising an alarm signal generator generating an alarm signal when a moving vehicle is detected which is on a track or lane closest to the detector but not when a moving vehicle is detected on a track or lane adjacent the detector.

20. The circuit as claimed in claim 17, wherein said analyzer includes a magnetic field reversal detector and a comparator comparing a number of reversals within a predetermined time period for determining said lane or track on which said vehicle is traveling.

21. A stationary or slow moving train presence detection apparatus for detecting an object on a railroad track at a level crossing, the apparatus comprising:

an array of magnetometer detectors provided at ground level or buried below ground level near rails of said railroad track for detecting static magnetic field levels caused by ferromagnetic objects located overhead on said track at said crossing;

a recording device recording, as recorded values, magnetic field level signal values from said detectors when no object is present on said track at said crossing; and a train presence analyzer comparing signal values from said detectors to said recorded values and outputting a train presence output signal.

22. The apparatus as claimed in claim 21, further comprising:

logic control circuitry which includes the train presence analyzer circuitry;

magnetometer interface circuitry operatively connected to the array of magnetometers and which interface circuitry includes the recording device; and wherein the logic control circuitry commands the magnetometer interface circuitry to continuously sample and store the magnetic field levels of the array of magnetometers.

23. The apparatus of claim 22, wherein the crossing is located in an island section and which apparatus further comprises a first activity sensor set at a first end of the island and a second activity sensor set at a second end of the island, said first and second activity sensors are operatively connected to activity sensor interface circuitry; and wherein the magnetometer interface circuitry continues to sample and store the magnetic field levels of the array of magnetometers until activity is detected at the first or second activity sensor, whereupon the sampling is halted and a sample set is created as a base line for train presence analysis.

24. The apparatus of claim 23, wherein the sample set is at least one of the sets of readings taken between the time the crossing is cleared as a result of the generation of an approaching train signal and the sensing of activity at the first or second activity sensor.

25. The apparatus of claim 24, wherein the sample set is an average of several sample sets taken.

26. The apparatus of claim 23, wherein after the train presence analyzer determines the train has exited the island and the activity sensor on the end of the island from which the train will exit signals the train has passed an all clear signal is immediately sent which raises crossing gates and allows use of the crossing by traffic and thereby minimizing any delays in allowing traffic to use the crossing after it is safe for traffic to use the crossing.

27. The apparatus of claim 21 wherein the magnetometer detectors are fluxgate sensors.

28. A method for moving or stationary train presence detection at a railroad crossing comprising the steps of:

sampling magnetic field level signal values from an array of detectors in an island of a grade crossing when no train is present;

recording sets of magnetic field level signal values obtained from the sampling;

comparing the recorded field level signal values with readings taken from the array of detectors; and generating a train presence detection signal when train presence analysis means detects the presence of a train on comparison of the recorded sets with readings being taken by the array of detectors.

29. The method of claim 28 further comprising the steps of:

continuously sampling the detectors of the array and recording sets of magnetic field level signal values when no train is present in the island;

monitoring the approach to the island from both directions;

generating a train approach signal upon the detection of the approach of a train.

30. The method of claim 29 further comprising the steps of:

clearing the crossing and lowering gates at the crossing after receiving the train approach signal when it is determined the crossing will be unsafe with adequate time for traffic to clear the crossing;

halting sampling by the array upon the receipt of a signal that the train is about to enter the crossing;

generating a sample set of magnetic field level signal values for use as the recorded set, the sample set comprising at least one of the sets recorded between the time the crossing was cleared and the signal halting sampling is received; and continuously monitoring the array of detectors and comparing these readings with the recorded set to determine at the earliest possible moment when the train has exited the crossing so that gates can be raised and traffic can use the crossing without undue delay after the crossing becomes safe for traffic to use it.

31. The method of claim 30 wherein the step of generating a sample set comprises taking the average of the last several sets of magnetic field level signal values recorded between the time the crossing is cleared and the signal halting sampling is received.

32. A method for the safe control and operation of a railroad grade crossing comprising the steps of:

monitoring the approaches to a crossing for reversal activity which would indicate a train is approaching;

determining that observed reversal activity is the signature of a train and thus indicates the presence of a train;

determining the speed of the train as it approaches the crossing by looking for its signature at successive sensors that the train will pass as it approaches the crossing and thereby specify when to declare the crossing unsafe, with adequate warning time for traffic and pedestrians to clear the crossing;

determining the direction of the approaching train based on the sequence in which the sensors detect the signature of the train; and declaring the crossing safe when no signature activity exists at any sensor and the sequence of reversal activity in the sensor array indicates that it is not possible for a train of short length to be in transition between outer and inner sensors.

33. The method of claim 32 comprising the further step of: determining, in a multi-track crossing, the track which an approaching train occupies.

34. The method of claim 33 comprising the further step of: monitoring for the approach for at least a second train on an adjacent track during passage of the first train through the crossing.

* * * * *